US008267610B2

(12) United States Patent
Goodman

(10) Patent No.: US 8,267,610 B2
(45) Date of Patent: Sep. 18, 2012

(54) APPARATUS FOR STORING AND HYGENICALLY DISPENSING A CLEANSING SOLUTION

(76) Inventor: Avery Goodman, Greendale, WI (US)

( * ) Notice: Subject to any disclaimer, the term of this patent is extended or adjusted under 35 U.S.C. 154(b) by 1441 days.

(21) Appl. No.: 11/830,149

(22) Filed: Jul. 30, 2007

(65) Prior Publication Data

US 2009/0035052 A1 Feb. 5, 2009

(51) Int. Cl.
*B43K 5/00* (2006.01)

(52) U.S. Cl. ..... 401/202; 401/127; 401/188 R; 401/205; 401/207; 401/266; 222/183; 222/205

(58) Field of Classification Search ..... 401/127, 401/188 R, 202, 205, 207, 222, 263, 265, 401/266; 222/183, 192, 205, 321.6; 239/548, 239/556, 558, 559, 566, 567
See application file for complete search history.

(56) References Cited

U.S. PATENT DOCUMENTS

| | | | | |
|---|---|---|---|---|
| 3,563,425 | A | 2/1971 | Clark | |
| 4,087,022 | A | 5/1978 | Zanetti-Streccia | |
| 4,646,945 | A | 3/1987 | Steiner | |
| 4,735,347 | A | 4/1988 | Schultz et al. | |
| 4,738,669 | A | 4/1988 | Vlock | |
| 4,809,878 | A | 3/1989 | Rainey | |
| 5,217,148 | A | 6/1993 | Cater | |
| 5,311,986 | A | 5/1994 | Putz | |
| 5,385,643 | A | 1/1995 | Ampuiski | |
| 5,439,521 | A | 8/1995 | Rao | |
| 5,443,084 | A | 8/1995 | Saleur | |
| 5,526,960 | A | 6/1996 | Breidenbach et al. | |
| 5,863,663 | A | 1/1999 | Mackey et al. | |
| 6,019,535 | A | 2/2000 | Turner | |
| 6,158,674 | A | 12/2000 | Humphreys | |
| 6,193,106 | B1 | 2/2001 | Ho et al. | |
| 6,360,753 | B1 * | 3/2002 | Vickers | 401/263 |
| 6,457,893 | B1 | 10/2002 | Hamilton | |
| 6,520,942 | B1 | 2/2003 | Putman | |
| 6,708,845 | B2 | 3/2004 | Weng | |
| 6,736,562 | B2 * | 5/2004 | Whitmore | 401/202 |
| 6,918,513 | B1 | 7/2005 | Downey | |
| 7,004,659 | B1 | 2/2006 | Goodman | |
| 7,578,388 | B2 * | 8/2009 | O'Connell et al. | 222/205 |
| 7,984,832 | B2 * | 7/2011 | Pivonka et al. | 222/205 |

OTHER PUBLICATIONS

Advertisment Just Rite Utility Products.
www.justritemfg.com/utility.tpl.

* cited by examiner

*Primary Examiner* — Steven J Ganey

(57) ABSTRACT

An apparatus for dispensing a cleansing solution on to a tissue comprised of: a reservoir container forming an interior volume for holding a cleansing solution and an opening that provides access to the interior volume; a dispersion component comprised of an upper surface, a lower surface, a plurality of holes on the upper surface, and at least one channel between the upper and lower surfaces; and a pump assembly comprised of a tubular member extending from the interior volume of the reservoir container, through the opening, and mated to the lower surface of the dispersion component, in which the pump assembly defines an actuator for pumping the cleansing solution from said interior volume of the reservoir container, through the one or more channels, and through the holes of the upper surface of said dispersion component when a pressure is applied to the dispersion component.

17 Claims, 10 Drawing Sheets

APPARATUS FOR STORING AND HYGENICALLY DISPENSING A CLEANSING SOLUTION

FIELD OF INVENTION

This invention relates generally to dispensing devices, and more particularly to a device for aesthetically storing and hygienically dispensing a cleansing solution onto a tissue.

BACKGROUND

Figure 1:
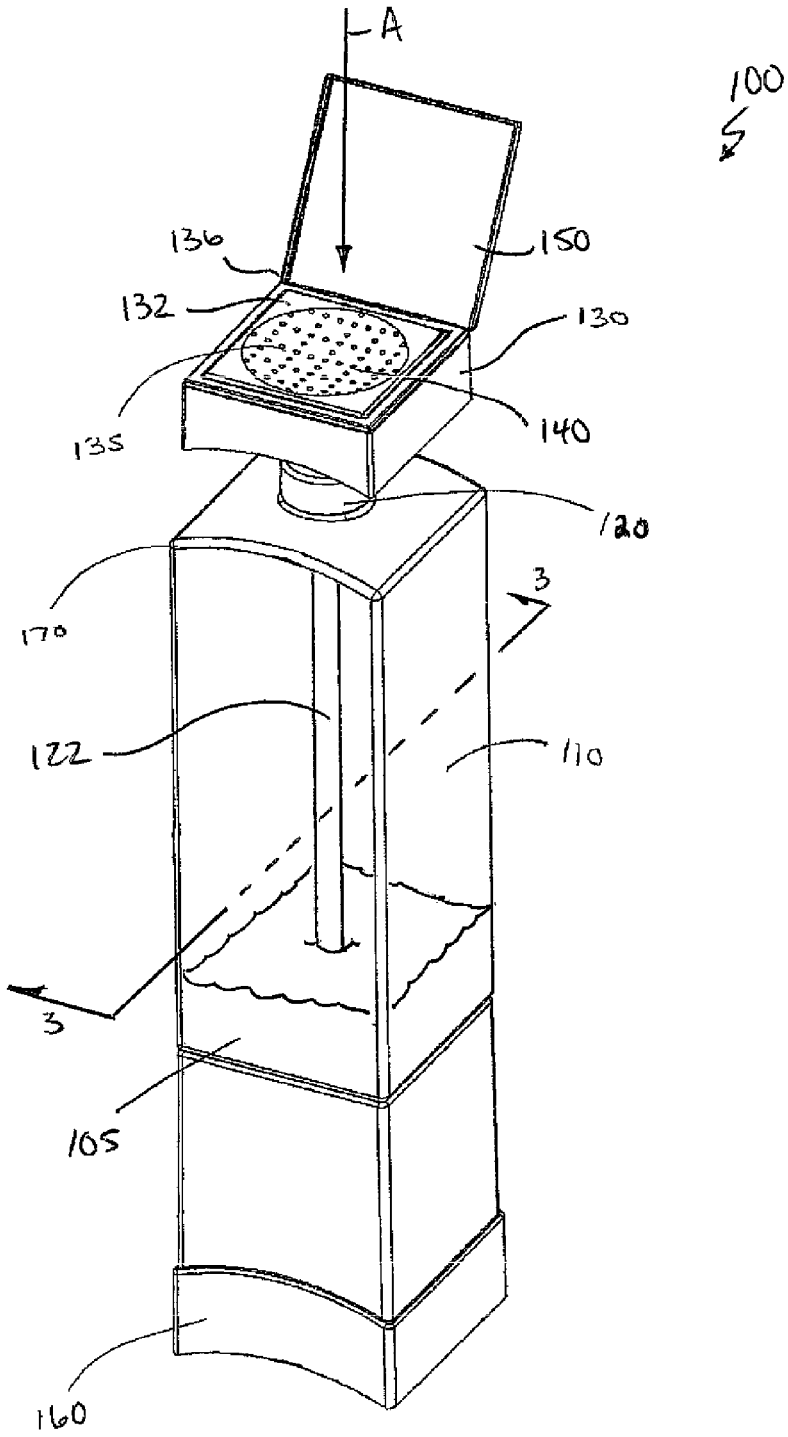
FIG. 1 shows a side perspective view of one embodiment of a dispensing apparatus for a cleansing solution, which includes an optional lid for covering the dispersion component.

It is desirable to have a method and apparatus for dispensing a cleansing solution on a tissue without spilling the cleansing solution. Since multiple persons may use an apparatus, is also desirable that the dispensing apparatus be designed in a manner that minimizes the transmission of bacteria and is capable of being used so that the hands of the users do not come in direct contact with the apparatus when the cleansing solution is dispensed. It is further desirable to design a dispensing apparatus that is dimensionally and aesthetically proportioned to be displayed or stored in conventionally designed bathrooms, hospitals, laboratories, mobile units and kitchens and allows users alternative configuration options (such as a detachable base which alters the height) for displaying or storing the dispensing apparatus on the floor, countertops, toilet tank, within cabinetry or shelving units, or on other surfaces, depending on the preference of the consumer.

As used herein, the term "solution" refers to a liquid, gel, vapor, oil or powder. A solution may include a personal cleansing solution, a cleansing product used on objects or clothing, a cosmetic, a pet product, a bleaching solution, a dye, a tint or combinations thereof.

As used herein, the term "tissue" refers to any paper, cloth, cotton fiber, natural or synthetic object that has the capability to absorb, partially absorb, and/or disperse a solution. For example, a tissue may include a Kleenex® brand tissue, toilet tissue, paper towel, a cloth, a synthetic cloth or a cotton ball, pad or swab or any other cloth or paper product designed to retain a liquid or solution.

Detailed Description of Embodiments of the Invention

For the purpose of promoting an understanding of the present invention, references are made in the text hereof to embodiments of an apparatus for dispersing a cleansing solution on a tissue, only some of which are depicted in the figures. It should nevertheless be understood that no limitations on the scope of the invention are thereby intended. One of ordinary skill in the art will readily appreciate that modifications such as those involving the number of components, positioning of the components relative to one another, materials from which the components are made, the size of the components, and the inclusion of additional elements do not depart from the spirit and scope of the present invention. Some of these possible modifications are mentioned in the following description. In addition, in the embodiments depicted herein, like reference numerals refer to identical structural elements in the various drawings. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

Moreover, the term "substantially" or "approximately" as used herein may be applied to modify any quantitative representation that could permissibly vary without resulting in a change in the basic function to which it is related. For example, one embodiment of the apparatus for evenly dispersing a cleansing solution on tissue includes a cap with holes on the upper, substantially smooth surface of the dispersion component. The holes may be of uniform or varying sizes or on a different surface, or the upper surface may be non-smooth and still be within the scope of the invention if its functionality is not materially altered.

FIG. 1 shows a side perspective view of one (1) embodiment of dispensing apparatus 100, which includes reservoir container 110 and pump assembly 120 (pump assembly 120 is an apparatus known in the art for pumping liquid or gel from a container) and which contains cleansing solution 105. FIG. 1 further depicts dispersion component 130, which contains plurality of holes 140 of varying sizes to control the flow of cleansing solution 105 over the top surface of dispersion component 130 when an axial pressure is applied to pump assembly 120. FIG. 1 further shows lid 150, which may be omitted or differently shaped in other embodiments. In the embodiment shown, lid 150 is pivotally attached at outer edge 136 of dispersion component 130. In other embodiments, lid 150 may be detached, may be ridged and constructed to attach to reservoir container 110 (which may have a mating portion), may be a seal, snap-on lid or any other component adapted for sealing or covering holes 140 in reservoir container 110.

In the embodiment shown, dispersion component 130 consists of upper panel 132 and lower panel 134. In the embodiment shown, upper panel 132 contains concave depression 135. In other embodiments, concave depression 135 may be a depression which is more or less shallow or pronounced, or concave depression 135 may be entirely omitted. In the embodiment shown, dispersion component 130 (including upper panel 132 and lower panel 134) is made of molded plastic, but in other embodiments may be made of metal, glass, rubber or any other man-made or synthetic material, and furthermore disperson panel 130 may be a singly molded part rather than constructed of separately molded components or panels.

In the embodiment shown, pump assembly 120 is a conventional pump assembly known in the art and includes tubular member 122. In the embodiment shown, reservoir container 110 is partially transparent and made of a tinted plastic. However, in other embodiments, reservoir container 110 may be opaque, transparent, partially transparent, tinted, and further may be made of plastic, rubber, glass, resin, metal or any other substance capable of being adapted to a desired shape and having the same functionality. Reservoir container 110 may further be comprised of a single molded piece or may be constructed from multiple functional and/or ornamental components to appeal to consumer preference and which may alter the aesthetic appearance, cost of manufacturing or durability of reservoir container 110 without altering its functionality. Further, it is anticipated that reservoir container 110 may be sold separately from pump assembly 120 as a refill unit. In other embodiments, pump assembly 120 may contain a locking or securing mechanism commonly known in the art for preventing spillage or leakage when pump assembly 120 is not in use.

In the embodiment shown, reservoir container 110 is nine inches (9") tall with a generally rectangularly shaped base that is approximately three inches (3") wide. However, in other embodiments of dispensing apparatus 100, reservoir container 110 may be any size or dimension and may be spherical, rectangular, square, octagonal, partially spherical or any other shape capable of being adapted to function as reservoir container 110. In other embodiments, reservoir container 110 may be disposable when empty and replaced with a new reservoir container 110 containing cleansing solution 105.

In the embodiment shown, dispensing apparatus 100 further includes multifunctional cap 160, which may be detached and fitted over top edge 170 of reservoir container 110 to conceal pump assembly 120 and dispersion component 130 or may be attached to the base (as shown) to add height to dispensing apparatus 100.

Figure 2A:
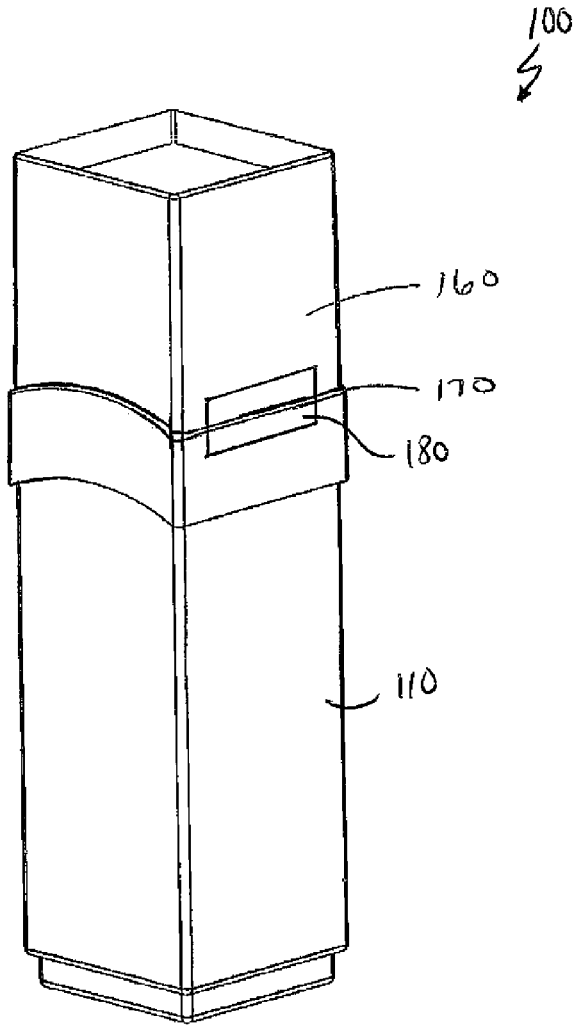
FIG. 2*a* shows side perspective view of the embodiment of the dispensing apparatus for a cleansing solution shown in FIG. 1 in which a multifunctional cap has been fitted over the top of the dispensing apparatus.

FIG. 2*a* shows a side perspective view of the embodiment of dispensing apparatus 100 shown in FIG. 1 in which multifunctional cap 160 has been fitted over the pump assembly (not visible) and the dispersion component (also not visible) and mated with top edge 170, thus concealing the pump assembly and dispersion component and giving dispensing apparatus 100 a streamlined and aesthetically distinctive appearance while protecting the pump assembly and dispersion component from dust, moisture and bacteria. In the embodiment shown, dispensing apparatus 100 may further include adhesive component 180, which attaches and affixes multifunctional cap 160 to one or more sides of reservoir container 110 to adapt and seal dispensing apparatus 100 for sale and display so that further packaging is not required. In the embodiment shown, adhesive component 180 is a small segment of adhesive tape, but can be any temporary adhesive commonly known to one of ordinary skill in the art. However, in other embodiments, adhesive component 180 may be omitted, or dispensing apparatus 100 may be enclosed in additional packaging or wrapping.

Figure 2B:
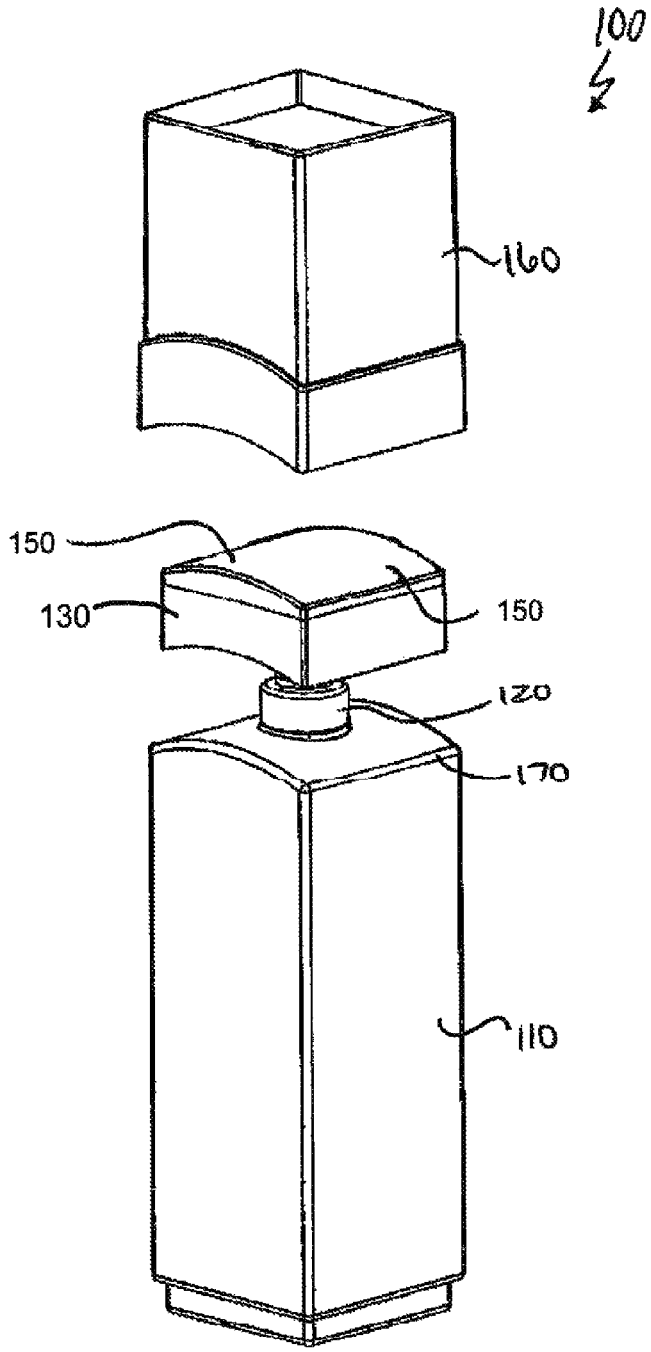
FIG. 2*b* shows a side perspective view of the embodiment of the dispensing apparatus for a cleansing solution shown in FIG. 2*a* in which the multifunctional cap is detached.

FIG. 2*b* shows a side perspective view of the embodiment of dispensing apparatus 100 shown in FIG. 1 in which multifunctional cap 160 has been detached from reservoir container 110, thus revealing the upper portion of pump assembly 120, to which when pressure is applied, the cleansing solution (not shown) flows over dispersion component 130. In the embodiment shown, upper panel 132 of dispersion component 130 is substantially smooth with holes 140. However, in other embodiments, upper surface 131 may be textured, serrated, have bumps or grooves or be of any other texture, molded shape or finish.

Figure 3A:
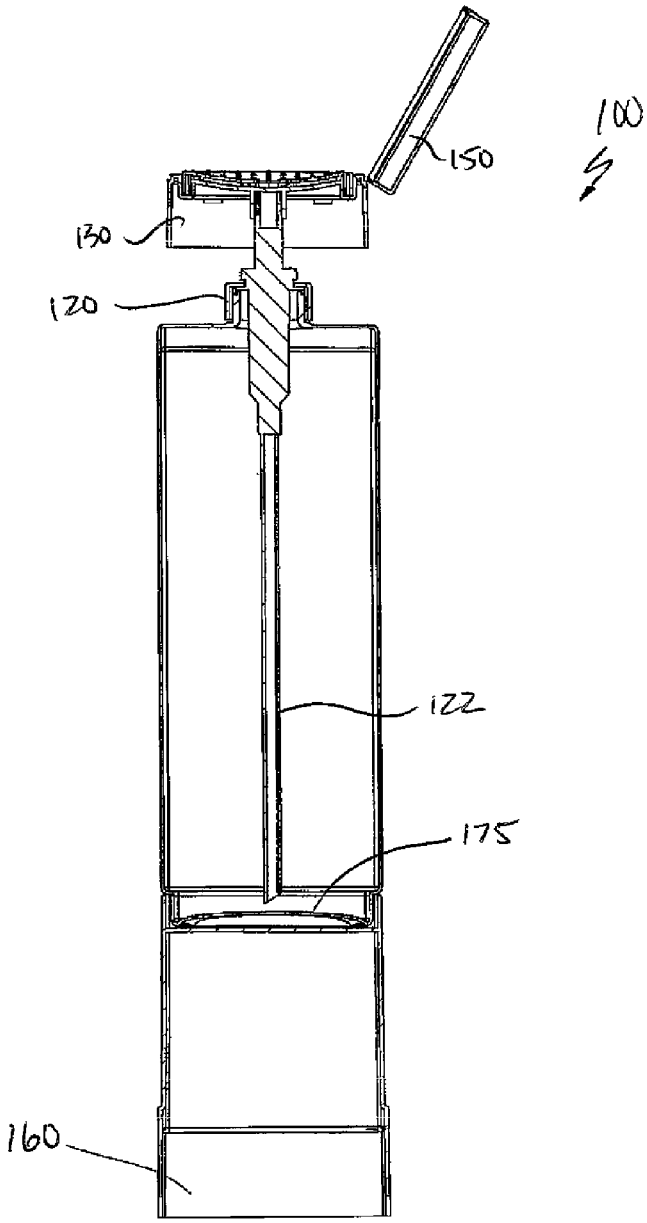
FIG. 3*a* shows a cross-sectional view of the embodiment of the dispensing apparatus for a cleansing solution shown in FIG. 1 taken along line 3-3 of FIG. 1 in which the lid is in the open position and in which the cap is non-permanently attached to the dispensing apparatus as a base.

FIG. 3*a* shows a cross-sectional view of the embodiment of dispensing apparatus 100 for a cleansing solution shown in FIG. 1 taken along line 3-3 in which lid 150 is in the open position and in which multifunctional cap 160 is non-permanently attached to bottom edge 175 of dispensing apparatus 100 as a base and may optionally be used to increase the height of dispensing apparatus 100. In the embodiment shown, multifunctional cap 160 is non-permanently attached as a base to increase the height of dispensing apparatus 100 so that it can be placed on the floor near a toilet or sinks and can be permanently attached to bottom edge 175 once removed from covering the dispersion component (not shown), i.e., the top of dispensing apparatus 100. However, in other embodiments, multifunctional cap 160 may be stored or discarded so that dispensing apparatus 100 is of an alternate height and may be more appropriate to be placed on a countertop, toilet tank or within a storage unit or area.

Figure 3B:
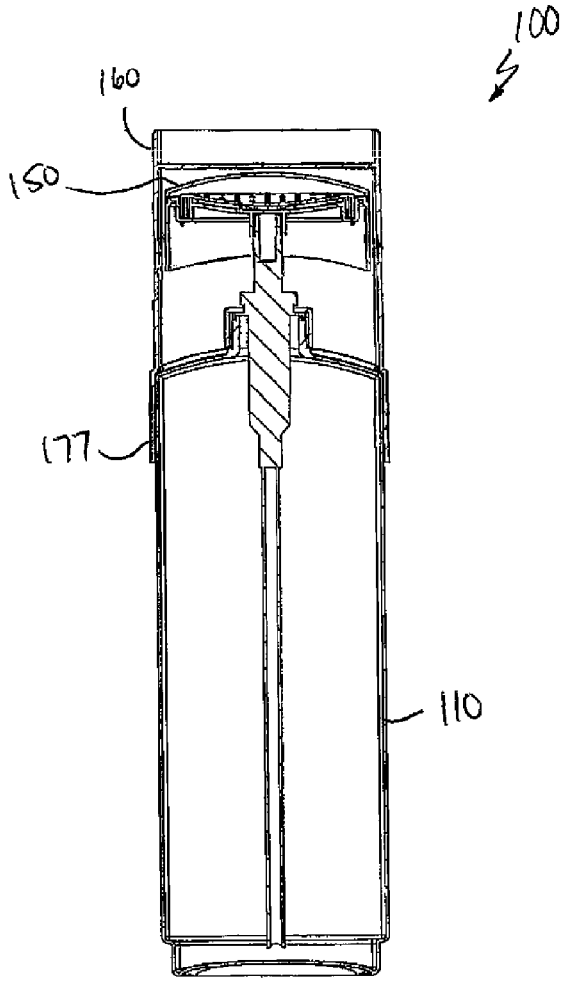
FIG. 3*b* shows a cross-sectional view of the embodiment of the dispensing apparatus for a cleansing solution shown in FIG. 1 taken along line 3-3 of FIG. 1 in which the lid is in the closed position.

FIG. 3*b* shows a cross-sectional view of the embodiment of dispensing apparatus 100 for a cleansing solution shown in FIG. 1 taken along line 3-3 in which lid 150 in the closed position and with multi-functional cap 160 positioned over dispersion component 130. As can be appreciated, multi-functional cap 160 extends downward, partially along the side surfaces of reservoir container 110 to provide a secure mating between multi-functional cap 160 and reservoir container 110.

Figure 4:
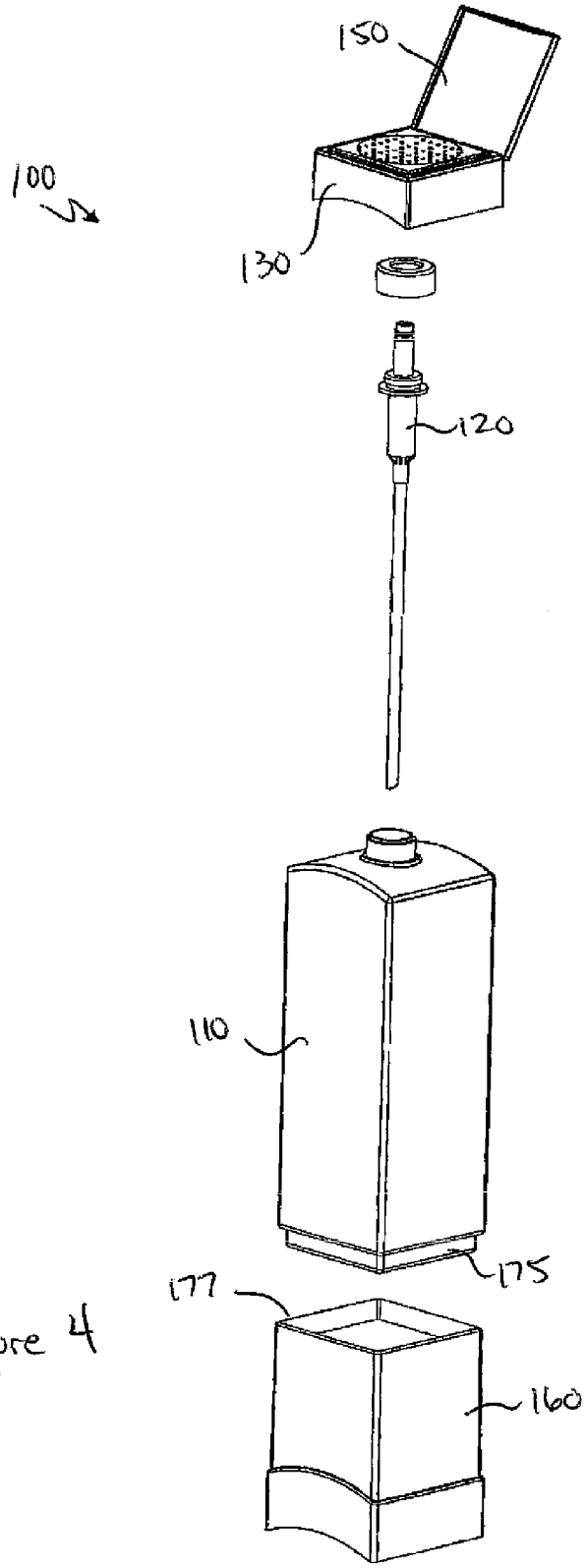
FIG. 4 shows an exploded side perspective view of the embodiment of the dispensing apparatus shown in FIG. 1.

FIG. 4 shows an exploded side perspective view of the embodiment of dispensing apparatus 100 shown in FIG. 1. As can be appreciated, bottom edge 175 of dispensing apparatus 100 is configured to fit or mate permanently or non-permanently to top edge 177 of multifunctional cap 160. In other embodiments, bottom edge 175 and/or top edge 177 may be differently shaped or configured for mating or fitting together permanently or non-permanently, or may include an additional adhesive layer or other stabilization component.

Figure 5:
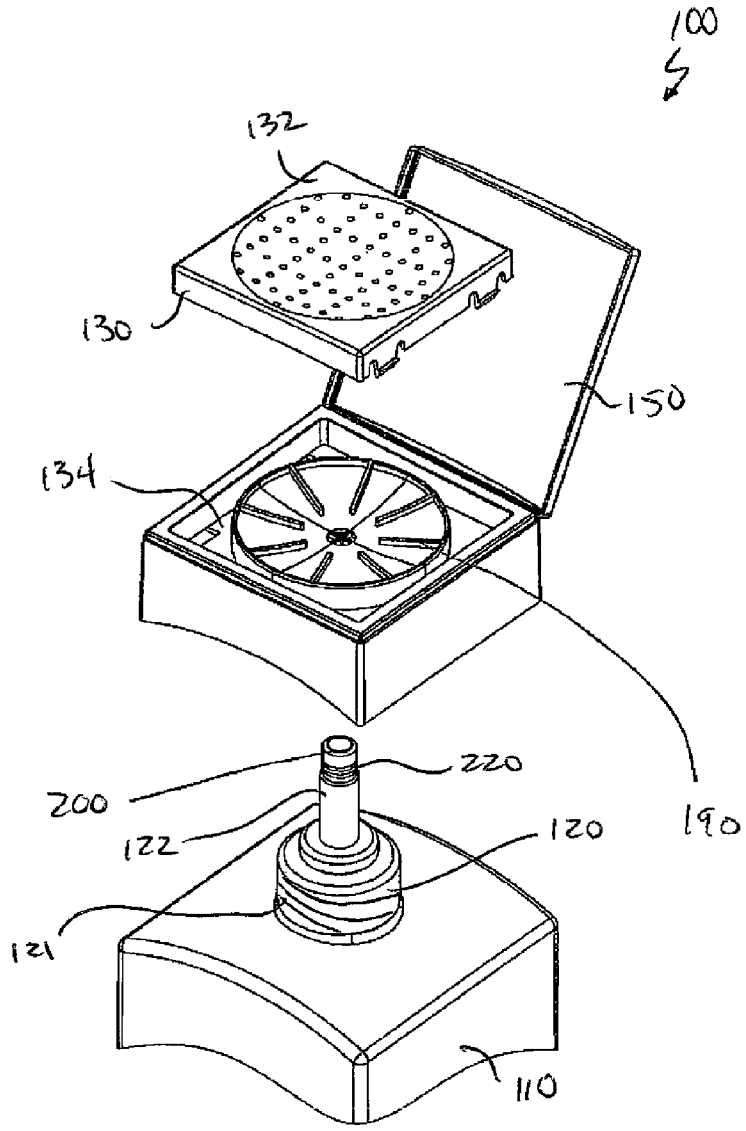
FIG. 5 shows an exploded view of one embodiment of the upper portion of the dispensing apparatus.

FIG. 5 shows an exploded view of one (1) embodiment of the upper portion of dispensing apparatus 100; specifically the upper portion of reservoir container 110, pump assembly 120, and dispersion component 130. As can be seen, the upper portion of dispensing apparatus 100 contains a system of channels 190 beneath dispersion component 130 through which the cleansing solution (not shown) is dispersed in a controlled manner through varying size holes 140. In the embodiment shown, dispersion component 130 includes upper panel 132 and lower panel 134, which are mated or fitted together to form channels 190. In other embodiments, dispersion component 130 may be a singly molded component or consist of a single piece. In other embodiments, upper panel 132 and lower panel 134 may be attached by snapping, gluing, welding, screwing, be pivotally attached, or permanently or temporarily secured to one another by any mechanism commonly known and used in the art. In the embodiment shown, dispersion component 130 further contains varying size holes 140, which are smaller in diameter near top opening 200 of tubular member 122 and increase in size outward of top opening 200 of tubular member 122 in order to evenly distribute the cleansing solution when a downward pressure is placed on dispersion component 130 to activate pump assembly 120. In other embodiments of dispensing apparatus 100, holes 140 may not vary in size or may be fewer or greater in number or differently dispersed. Other embodiments may have fewer or more channels 190, a different configuration of channels 190, or may omit channels 190 altogether so long as the cleansing solution flows through holes 140 when dispersion component 130 is subject to a downward pressure.

Also shown in FIG. 5 are ridged coupling member 220 through which pump assembly 120 extends outwardly though reservoir container 110 and connects to the bottom surface (not shown) of dispersion component 130. In the embodiment shown pump assembly 120 is connected to reservoir container by screw-on cap, 121. In other embodiments, pump assembly 120 may be connected to reservoir container 110 by welding, adhesive or pressure. In other embodiments, pump assembly 120 may be removable to allow exchange, refill or replacement of reservoir container 110 Other embodiments of dispensing apparatus 100 may omit ridged coupling members 220 and 230, may contain additional coupling components, or could use an alternative permanent or non-permanent means of coupling or attaching such as welding or gluing.

Figure 6:
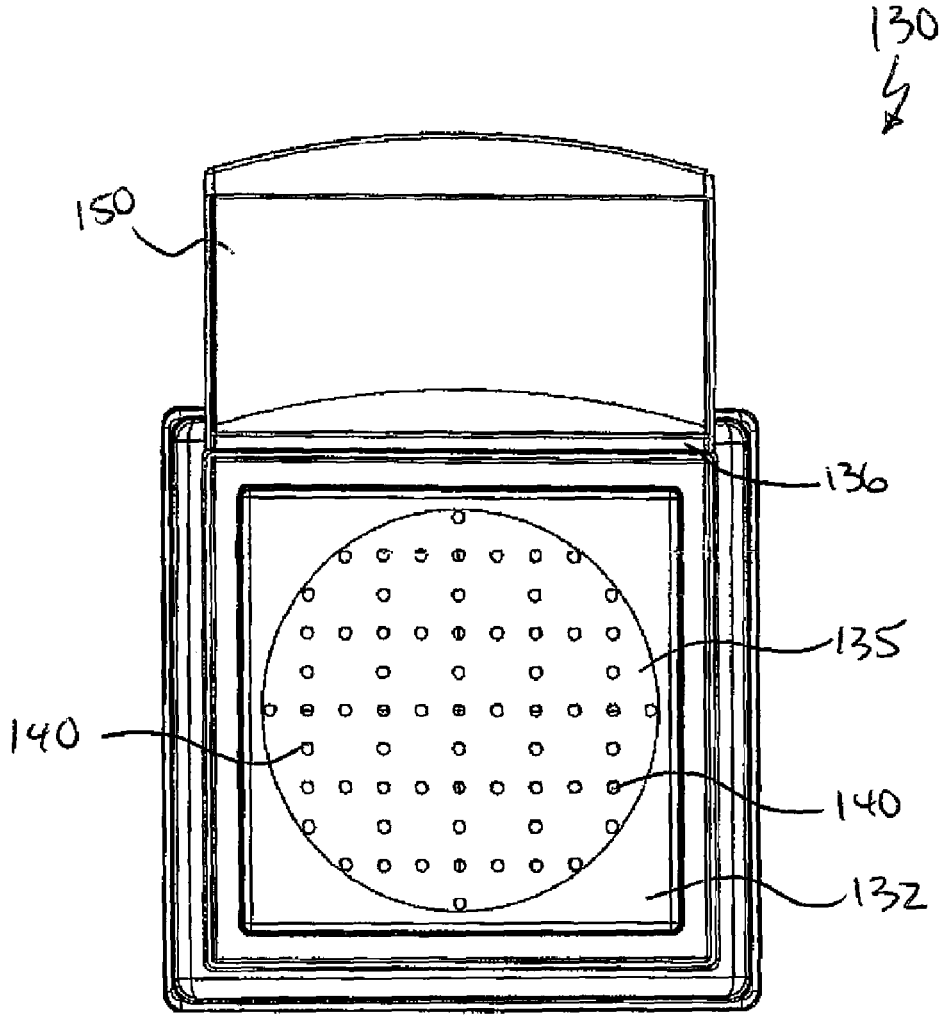
FIG. 6 shows a top view of one embodiment of the upper surface of the dispersion component, which contains holes that are approximately uniform in size.

FIG. 6(*a*) shows a top view of one (1) embodiment of the upper surface of dispersion component 130. Dispersion component 130 is comprised of upper panel 132, depression 135 (the exact contour of depression 135 is not visible from this perspective), lid 150, outer edge 136, which connects lid 150 to upper panel 132, and holes 140 in which the upper surface is substantially smooth. In other embodiments, the upper surface may be textured, serrated, have bumps or grooves, or be of any other texture, molded shape or finish. Also, as provided supra, the upper surface of dispersion component 130 need not have depression 136 and holes 140 need not be uniform in size. In other embodiments, the upper surface of dispersion component 130 made be of lighter colors which assist in detecting possible contamination or bacteria growth.

FIG. 6(*b*) shows a bottom perspective exploded view dispersion component 130, from which revealing mating component 132 is visible, and which connects pump assembly 120 to dispersion component 130. In alternative embodiments mating component 132 may be a threaded member, snap-on component or ridged member.

Figure 7:
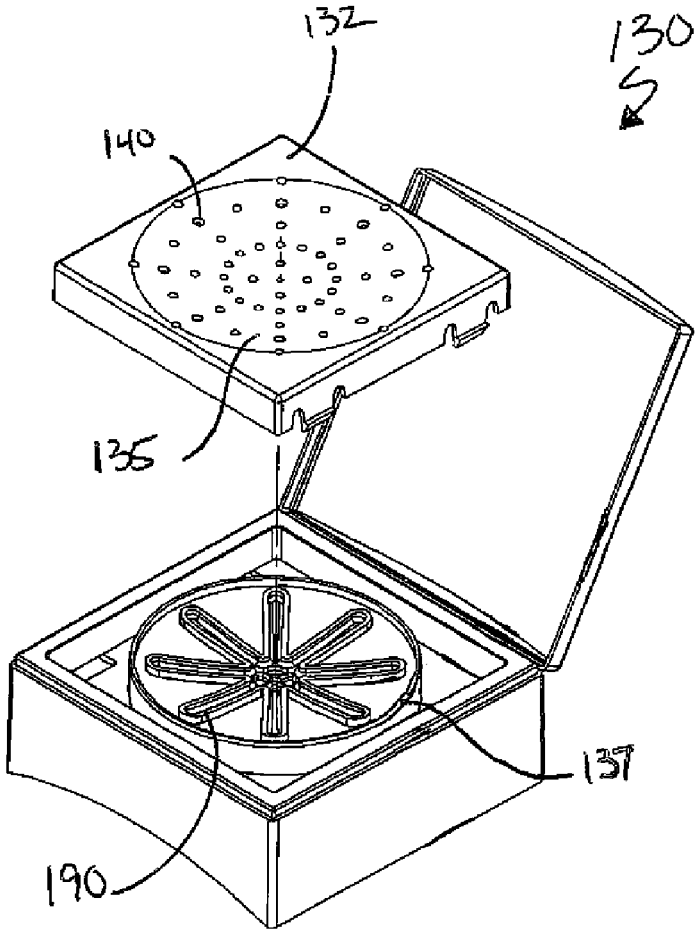
FIG. 7 shows an exploded top perspective view of one alternate embodiment of the dispersion component, from which an alternate pattern of the channels can be seen.

FIG. 7 shows an exploded top perspective view of one (1) alternate embodiment of dispersion component 130, from which an alternate pattern formed by channels 190 can be seen (as compared to the pattern visible in FIG. 5). In this embodiment, channels 190 are formed on the bottom portion of dispersion component 130 and have an open top. When mated with the top portion, the underside surface (not visible) of the top portion forms the top of channels 190, allowing the cleansing solution (not shown) to pass through channels 190, through holes 140, and out from dispersion component 130. Also visible in FIG. 7 is circular rib 137. Rib 137 creates a fluid seal with the underside of the top portion to prevent leakage of the cleansing solution. It should be noted too that FIG. 7 depicts only one (1) alternate embodiment of a contemplated pattern of channels 190 and that other embodiments may have fewer, more or differently shaped channels 190 or that channels 190 may be wider, narrower or differently shaped. For example, channels 190 may be rectangular or irregular rather than of a regular cylindrical shape.

Figure 8:
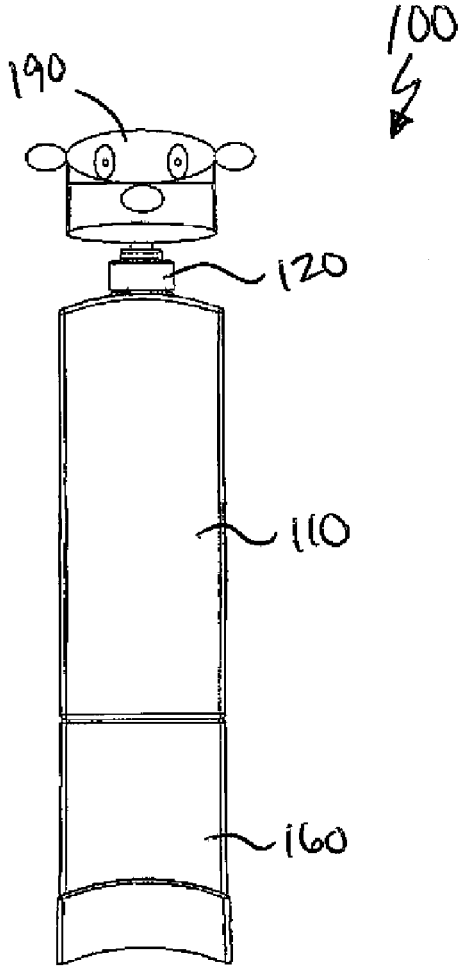
FIG. 8 shows a front view of one embodiment of the dispensing apparatus to which ornamentation is affixed.

FIG. 8 shows a front view of one (1) embodiment of dispensing apparatus 100 to which ornamentation 190 is affixed. In the embodiment shown, ornamentation 190 is a dog's face. However, it should be understood that ornamentation 190 could be another animal's face or another animal, a person or person's face, a caricature of a person or person's face, a clown face, or an object such as a baseball, football, or basketball, a racecar, a plant or any other likeness or object that provides an aesthetic or otherwise distinctive visual effect.

While the dispensing apparatus has been shown and described with respect to several embodiments and uses in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. An apparatus for dispensing a cleansing solution on to a tissue comprised of:

a reservoir container having an interior and an exterior, forming an interior volume, and having an opening that provides access to said interior volume;

a dispersion component comprised of an upper surface and a lower surface attached to said opening of said reservoir container and having a plurality of holes through which a fluid is dispersed and further having at least one channel above said lower surface of said dispersion component; and a pump assembly comprised of a tubular member extending from said interior volume of said reservoir container, through said opening of said reservoir container, connecting to said lower surface of said dispersion component, said pump assembly defining an actuator for pumping said cleansing solution from said interior volume of said reservoir container, through said at least one channel, and through at least a portion of said plurality of holes of said upper surface of said dispersion component when a pressure is applied to said dispersion component, wherein each of said plurality of holes is of varying sizes to further control dispersion of said cleansing solution, wherein said apparatus further includes a cap which covers said dispersion component.

2. The apparatus of claim 1, wherein said upper surface of said dispersion component is concavely shaped.

3. The apparatus of claim 1, wherein said apparatus further includes a lid covering each of said plurality of holes on said upper surface of said dispersion component.

4. The apparatus of claim 3, wherein said lid is hinged.

5. The apparatus of claim 1, wherein said cap may be attached to a bottom of said reservoir container as a base.

6. The apparatus of claim 1, wherein said holes increase in size radially outwardly from a center of said dispersion component.

7. The apparatus of claim 1, wherein bumps protrude from said dispersion component.

8. An apparatus for dispensing a cleansing solution on to a tissue comprised of:

a reservoir container, said reservoir container having an interior and an exterior, forming an interior volume and having an opening that provides access to said interior volume;

a dispersion component, said dispersion component constructed from a top portion and a bottom portion which mate to form at least one channel therebetween, an upper surface, a lower surface, a plurality of holes of varying sizes disposed on said upper surface and through which said cleansing solution is dispersed in a substantially even manner, wherein said apparatus further includes a cap which covers said dispersion component; and a pump assembly, said pump assembly comprised of a tubular member extending from said interior volume of said reservoir container, through said opening of said reservoir container, and connected to said lower surface of said dispersion component, said pump assembly defining an actuator for pumping said cleansing solution from said interior volume of said reservoir container, through said at least one channel, and through said plurality of holes of said upper surface of said dispersion component when said dispersion component is subject to a pressure.

9. The apparatus of claim 8, wherein said upper surface of said dispersion component is concavely shaped.

10. The apparatus of claim 8, wherein said apparatus further includes a lid covering each of said plurality of holes on said upper surface of said dispersion component.

11. The apparatus of claim 8, wherein said cap may be attached to a bottom of said reservoir container as a base.

12. The apparatus of claim 8, wherein said holes increase in size radially outwardly from a center of said dispersion component.

13. The apparatus of claim 8, wherein bumps protrude from said dispersion component.

14. An apparatus for dispensing a cleansing solution on a tissue comprised of:

a reservoir container, said reservoir container having an interior and an exterior, forming an interior volume and having an opening that provides access to said interior volume;

a dispersion component, said dispersion component comprised of an upper surface and a lower surface, wherein said upper surface forms a concave depression and has a plurality of holes of varying sizes through which a fluid is dispersed in a substantially even manner, and wherein at least one channel is formed between said upper surface and said lower surface;

a pump assembly, said pump assembly comprised of a tubular member extending from said interior volume of said reservoir container, through said opening of said reservoir container, and connected to said lower surface of said dispersion component, said pump assembly defining an actuator for pumping said cleansing solution from said interior volume of said reservoir container, through said at least one channel, and through at least a portion of said plurality of holes of said upper surface of said dispersion component when subject to al pressure;

a lid which covers each of said plurality of holes of said dispersion component; and a cap which covers said dispersion component and which may be removed and attached to said reservoir container as a base.

15. The apparatus of claim 14, wherein said dispersion component is constructed from a top portion and a bottom portion which mate to form said at least one channel.

16. The apparatus of claim 14, wherein said holes increase in size radially outwardly from a center of said dispersion component.

17. The apparatus of claim 14, wherein bumps protrude from said dispersion component.

* * * * *